United States Patent [19]

Uchinami et al.

[11] Patent Number: 4,846,131

[45] Date of Patent: Jul. 11, 1989

[54] FUEL CONTROL APPARATUS FOR AN N-CYCLE ENGINE

[75] Inventors: Masanobu Uchinami; Yasuhiro Kimoto, both of Himeji, Japan

[73] Assignee: Mitsubishi Denki Kabushiki Kaisha, Tokyo, Japan

[21] Appl. No.: 183,096

[22] Filed: Apr. 19, 1988

[30] Foreign Application Priority Data

Apr. 30, 1987 [JP] Japan ..... 62-109321
Apr. 30, 1987 [JP] Japan ..... 62-109322

[51] Int. Cl.[4] ..... F02D 41/22; F02D 41/30; F02M 51/00

[52] U.S. Cl. ..... 123/479; 123/476; 123/490; 364/431.05

[58] Field of Search ..... 123/179 L, 476, 478, 123/479, 480, 482, 486, 487, 490, 491, 492, 493; 364/431.04, 431.05, 431.11, 133

[56] References Cited

U.S. PATENT DOCUMENTS 4,471,739 9/1984 Yamato et al. ..... 123/479
4,476,830 10/1984 Hasegawa et al. ..... 123/479
4,582,035 4/1986 Kishi ..... 123/478
4,628,882 12/1986 Sakurai et al. ..... 123/478 X
4,664,082 5/1987 Suzuki ..... 123/479 X
4,732,122 3/1988 Scarnera et al. ..... 123/478 X
4,782,806 11/1988 Hatanaka ..... 123/478 X
4,791,569 12/1988 Suzuki ..... 364/133 X

FOREIGN PATENT DOCUMENTS 0054929 5/1981 Japan .

*Primary Examiner*—Willis R. Wolfe
*Attorney, Agent, or Firm*—Oblon, Spivak, McClelland, Maier & Neustadt

[57] ABSTRACT

In a fuel control apparatus for an n-cycle engine, when a cylinder discriminating means detects a value obtained by counting turning angle position signals is out a predetermined range, or when a detecting means detects that data of cylinder do not have values according to a predetermined order, a fuel-injection control means performs simultaneous injection of fuel to all cylinders, and thereafter the fuel injection is prohibited until the cylinder discriminating means detects a specified cylinder among the six cylinders.

6 Claims, 8 Drawing Sheets

FUEL CONTROL APPARATUS FOR AN N-CYCLE ENGINE

BACKGROUND OF THE INVENTION

Field of the Invention

The present invention relate to a fuel control apparatus for discriminating the cylinders of an engine to perform injection of fuel to the cylinders.

Discussion of Background

Heretofore, in order to operates an automobile engine smoothly, positions of turning angle of the crank shaft are detected, whereby fuel-injecting operations are carried out on the basis of the result of detection. The fuel-injection controlling apparatus for the engine will be described with reference to a timing chart as shown in FIG. 9.

In FIG. 9, a turning angle sensor detects a predetermined turning angle, for instance, for each turning angle of 1° CA (crank angle) when the crank shaft is rotated and outputs pulse signals $P_a$ indicative of each position of turning angles as shown in FIG. 9*a*. The turning angle sensor also outputs a reference signal $P_b$ as shown in FIG. 9*b* which is in synchronism with, for instance, BTDC 8° CA at the falling time of the pulse signal. The reference signal $P_b$ is determined in such a manner that the width in the high level of the reference signal $P_b$ is, for instance, 50° CA for the first cylinder as a standard, and the width is, for instance, 42° CA for the second through the sixth cylinders when the engine has six cylinders.

FIGS. 9*c*–9*h* respectively show timing charts for injecting fuel to the forth, the fifth, the sixth, the first, the second, and the third cylinders in this order, in which fuel injection is carried out when the signals are changed into "L" levels. Normally, the fuel-injecting operations are carried out as indicated by solid lines in FIG. 9 wherein the turning angle position signals $P_a$ are counted when the reference signal $P_b$ is in high ("H") levels. The counted value is compared with a predetermined value which is determined to be a value between 42 and 50. When the counted value is greater than the predetermined value, the counted value is judged to be the reference signal for the first cylinder. When the counted value is smaller than the predetermined value, the counted value is judged to be the reference signal for any cyliner amoung the second-the sixth cylinders, whereby a numerical value of "1" is added to the previous data of cylinder so that the data of cylinder for the cylinders are renewed. Thus, the fuel-injection is carried out for the cylinders which correspond to the data of cylinder obtained by the above-mentioned manner.

The data of cylinder are correctly supplied to perform the fuel-injection for the first-the sixth cylinders as shown in FIG. 9*i* when the reference signal $P_b$ contains no noise. In this case, the data of cylinder are renewed at each falling time of the reference signal $P_b$. For instance, when the data of cylinder show 1, the fuel-injection is conducted to the fifth cylinder as indicated by the solid line in FIG. 9*d*. Thus, the fuel-injection is regularly conducted as indicated by the solid lines in FIG. 9*c*–9*h* to the cylinders in accordance with the data of cylinder.

In the conventional fuel control apparatus for an automibile engine, for instance, when a noise is produced in the reference signal $P_b$, as indicated by one-dotted chain line in FIG. 9*b*, due to failure of contact in a connector used for the turning angle sensor, a pulse $P_{b1}$ in the reference signal $P_b$ may have its width corresponding to $L_1$° CA which exceeds the predetermined value, or a pulse $P_b2$ having its width corresponding to $L_2$° CA which is smaller than the predetermined value may be produced in an area where any pulse should not be produced. The pulse $P_{b1}$ which is greater than the predetermined value may give erroneous judgement for the reference signal concerning the first cylinder, whereby erroneous renewing of the data of cylinder from 2 to 1 takes place as shown in FIG. 9*j*, and the fuel-injection is erroneously carried out for the fifth cylinder as incicated by two-dotted chain line instead of the first cylinder without having supply of fuel as shown in FIGS. 9*d* and 9*f*. The pulse $P_{b2}$ having the value smaller than the predetermined value may cause erroneous renewing of the data of the cylinder by adding 1 to render the data to be 2 as shown in FIG. 9*j*, as the result of causing erroneous injection of fuel to the sixth cylinder as indicated by two-dotted chain line shown in FIG. 9*e*. Then, renewing of the data of cylinder takes place as shown in FIG. 9*j* due to the erroneous data of cylinder. Accordingly, there take place such problems that no fuel is supplied to the cylinder to which the fuel is to be supplied, and revolution of the engine becomes unstable to thereby invite engine-stop.

SUMMARY OF THE INVENTION

It is an object of the present invention to provide a fuel control apparatus for n-cycle engine capable of operating the engine smoothly even when noise components take place in the reference signal.

According to the present invention, there is provided a fuel control apparatus for an n-cycle engine which comprises:

a turning angle sensor which outputs a turning angle position signal each time the crank shaft of the n-cycle engine turns a predetermined angle, and outputs a reference signal of a predetermined range of the turning angle for each of the cylinders in n-cycle operations;

a cylinder discriminating means which counts the turning angle position signals in a rising time period or a falling time period in the reference signal, compares a counted value with a set value, and renews data of cylinder for the cylinders with respect to a specified cylinder; and, a fuel-injection control means for controlling injection of fuel to the cylinders having the renewed data, wherein when the cylinder discriminating means detects that the counted value is out the predetermined range, the fuel-injection control means performs simultaneous injection of fuel to all of the cylinders, and the fuel injection is prohibited until the cylinder discriminating means detects the specified cylinder.

Further, according to the present invention, there is provided a fuel control apparatus for n-cycle engine capable of operating the engine smoothly even when noises take place in the reference signal.

According to the present invention, there is provided a fuel control apparatus for an n-cycle engine which comprises:

a turning angle sensor which outputs a turning angle position signal each time the crank shaft of the n-cycle engine turns a predetermined angle, and outputs a reference signal of a predetermined range of the turning angle for each of the cylinders in n-cycle operations;

a cylinder discriminating means which counts the turning angle position signals in a rising time period or a falling time period in the reference signal, and which compares a counted value with a set value to thereby renew data of cylinder for a specified cylinder among the cylinders and for each of the other cylinders;

a fuel-injection control means for controlling injection of fuel to the cylinders having the renewed data; and, a detection means for detecting the data of cylinder being in disorder, wherein when the detection mean detects the data being in disorder, the fuel-injection control means performs simultaneous injection of fuel to all of the cylinders, and the fuel injection is prohibited until the cylinder discriminating means detects the specified cylinder.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the following, preferred embodiments of the present invention will be described with reference to the accompanying drawings.

Figure 1:
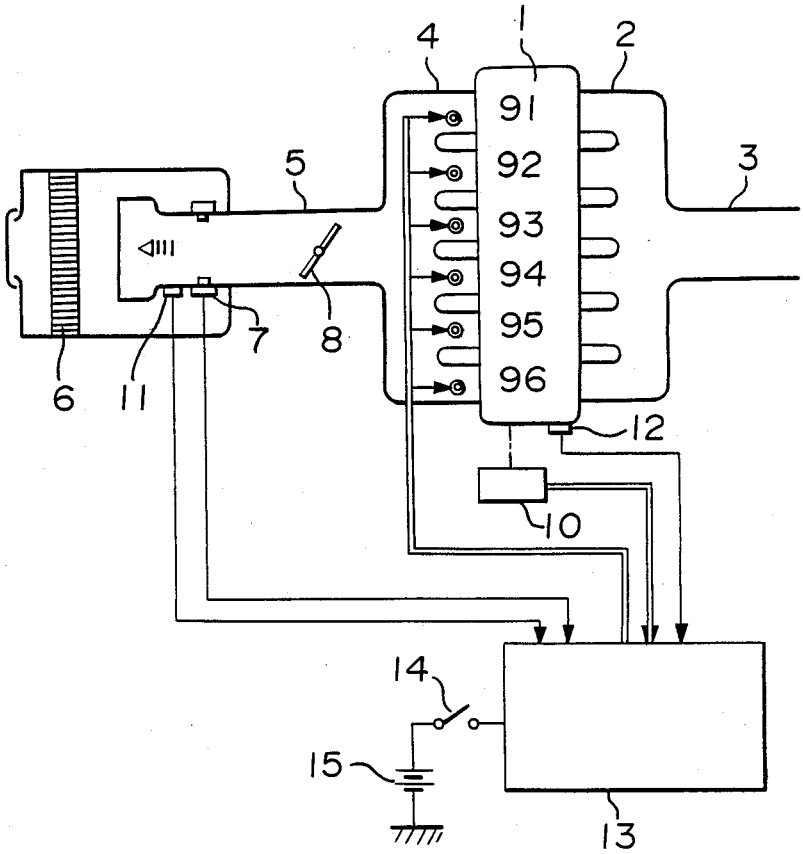
FIG. 1 is a diagram showing an embodiment of the fuel control apparatus for an n-cycle engine according to the present invention.

FIG. 1 is a diagram showing an embodiment of the fuel control apparatus according to the present invention, wherein a reference numeral 1 designates an n-cycle type six-cylinder engine which is to be mounted on, for instance, an automobile, a numeral 2 designates an exhaust manifold, a numeral 3 designates an exhaust tube connected to the exhaust manifold 2, a numeral 4 designates an intake manifold for the engine 1, and a numeral 5 designates an intake tube connected to the intake port of the intake manifold 4. The intake tube 5 is also connected at it upper stream side to an air cleaner 6. An air-flow sensor 7 (hereinbelow, referred to as AFS) for outputting a pulse signal having a frequency corresponding to the quantity of intake air A is attached to the intake tube 5. A throttle valve 8 is provided in the intake tube 5.

Numerals 91–96 respectively designate the first through the sixth electromagnetic type fuel-injection valves each being provided for the each of the first through the sixth cylinders to supply fuel in the engine. A numeral 10 designates a turning angle sensor which is adapted to output a turning angle position signals $P_a$ at each time of turning of the crank shaft of the engine 1 at a predetermined angle such as 1° CA as shown in FIG. 6*a* and to produce a reference signal $P_b$ which is in synchronism with, for instance, BTDC 8° CA at the falling time of the pulse signals in each of the predetermined range of turning angle corresponding to each of the cylinders in the n-cycle operations of the engine 1.

A numeral 11 designates an intake-air temperature sensor for detecting the temperature AT of the intake air, a numeral 12 designates a cooling water temperature sensor for detecting the temperature WT of cooling water for the engine 1, and a numeral 13 designates an electronic control device to which a power is supplied from a battery 15 through a key switch 14. The electronic control device 13 has input terminals connected to the AFS 7, the turning angle sensor 10, the intake-air temperature sensor 11 and the cooling water temperature sensor 12 so that on receiving detection signals it operates for calculation and judgement in accordance with a predetermined rule of processing. By the operation of the electronic control device, pulse signals for the first-the sixth electromagnetic type fuel-injection valves 91–96 are detected for discrimination of the cylinders and instruction signals are outputted to the valves in accordance with the discriminated data of cylinder.

Figure 2:
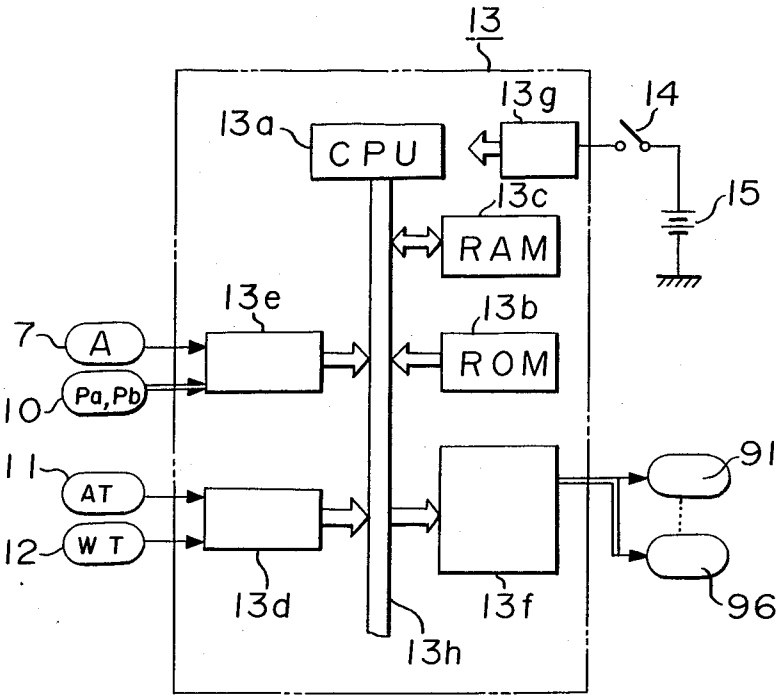
FIG. 2 is a block diagram of an embodiment of the electronic control device for the fuel control apparatus shown in FIG. 1.

The detailed construction of the electronic control device 13 will be described with reference to FIG. 2. A reference numeral 13 designates a central processing unit (hereinbelow, referred to as a CPU) to perform various operations, comparison and judgement, a numeral 13*b* designates a read-only-memory (ROM which stores a program according to the flow chart shown in FIGS. 3 to 5 to be executed by the CPU 13*a*), a numeral 13*c* designates a random access memory (RAM) as a memory for the CPU 13*a*, and a numeral 13*d* designates an input port for receiving the detection signals from the intake-air temperature sensor 11 and the cooling water temperature sensor 12 after the detection signals are converted into digital signals. A numeral 13*e* designates a counter circuit which counts the signals supplied from the AFS to transmit a signal representing the quantity of intake air A obtained by the counting to the CPU 13*a* and which receives the turning angle position signals $P_a$ and the reference signal $P_b$ from the turning angle position sensor 10 so that a counted value M to be used for comparing and a value of the revolution N of the engine are transmitted to the CPU 13*a*. A numeral 13*f* designates an output circuit which includes an injected-fuel quantity counter, by which data indicating the qutantity of fuel injected are set, so as to convert the data into pulse signals having a time width corresponding to the set data, the pulse signals being outputted to the first through the sixth electromagnetic type fuel injection valves 91–96 so as to correspond to the data of cylinder. A numeral 13*g* designates a power source circuit connected to the key switch 14 and a numeral 13*h* designated a bus line for connecting the structural elements indicated by 13*b*–13*f* to the CPU 13*a*.

Figure 3:
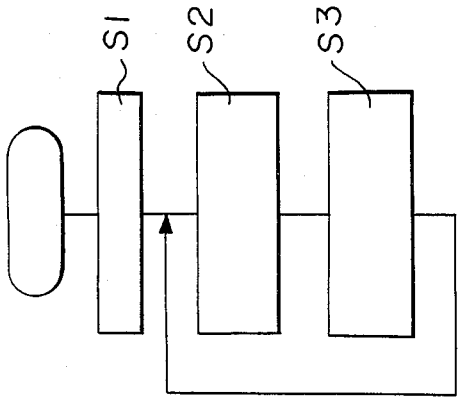
FIG. 3 is a flow chart of a main rutine executed by the electronic control device.
Figure 4:
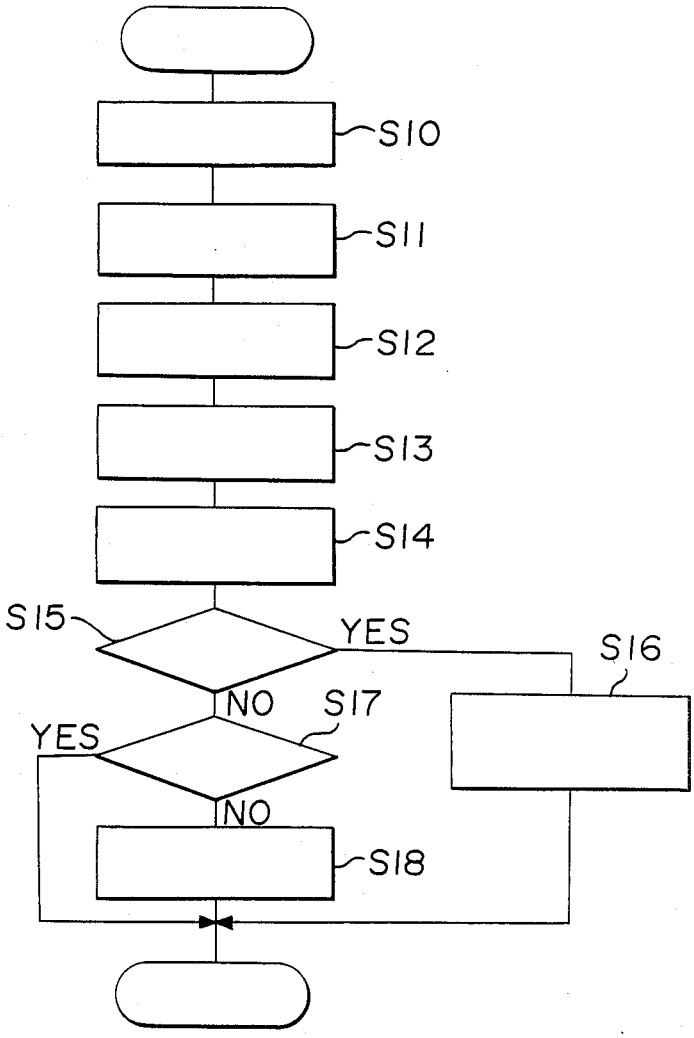
FIG. 4 is a flow chart of an embodiment of an interruption processing rutine inserted in the main rutine.
Figure 5:
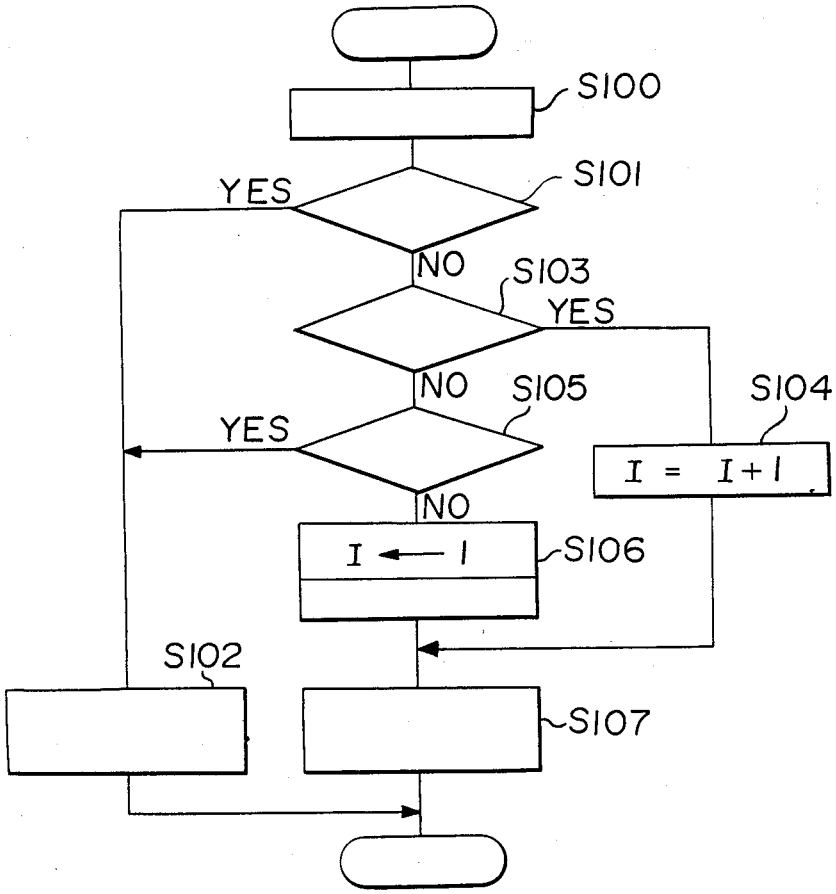
FIG. 5 is a flow chart of an embodiment of cylinder discriminating rutine to be inserted in the interruption rutine.
Figure 6:
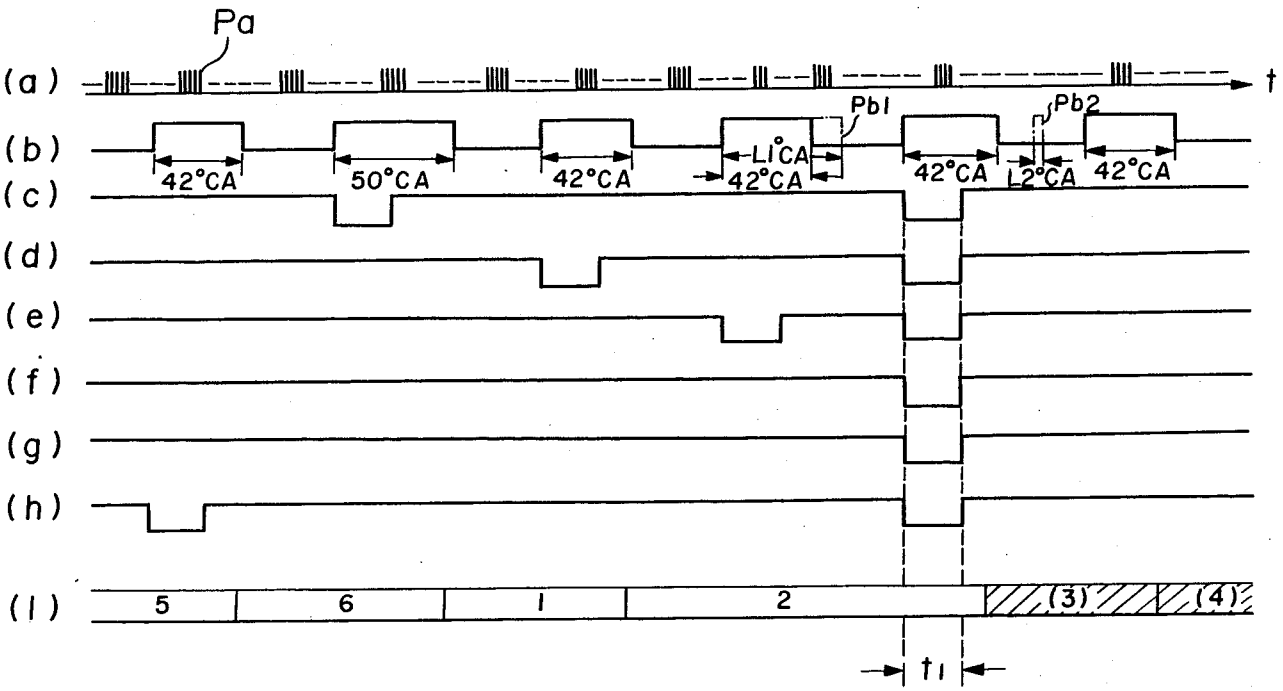
FIGS. 6*a–i* are a timing chart showing the operations of an embodiment of the fuel control apparatus of the present invention.

FIG. 3 is a flow chart showing the main rutine for the operations of the fuel control apparatus of the present invention; FIG. 4 is a flow chart for an interruption processing rutine inserted in the main rutine; and FIG. 5 is a flow chart of cylinder discriminating rutine inserted in the interruption processing rutine. FIG. 6 is a timing chart showing an embodiment of operation of the present invention in which the abscissa represents time, FIGS. 6*c* through 6*h* respectively show timing of fuel-injection for the fourth, the fifth, the sixth, the first, the second, and the third cylinders, and FIG. 6*i* shows data of cylinder.

The operation of the fuel control apparatus of the present invention will be described.

When the key switch 14 is turned on to connect the battery 15 to the power source circuit 13*g*, the electronic control device 13 is actuated. At first, execution of the main rutine as shown in FIG. 3 is started.

The main rutine is initialized at Step S1, and then, at Step S2, engine parameters as an intake-air temperature signal indicative of the temperature AT of the intake air and a cooling water temperature signal indicative of the temperature WT of the cooling water are read from the input port 13*d*. At Step S3, a correction coefficient K for correcting the quantity of principal injection W, which is described below, is processed on the basis of the intake-air temperature signal and the cooling water temperature signal. Thus obtained result is stored in the RAM 13*c* and then, returned to Step S2.

Usually, the main rutine is executed by repeating the Steps S2 and S3. For each falling time of the reference signal $P_b$ from the counter circuit 13*e*, the execution of the main rutine is immediately stopped, and the interruption processing rutine as shown in FIG. 4 is started.

In the interruption processing rutine, a cylinder discriminating operations as shown in FIG. 5 are processed on the basis of a reference value M as a counted value of the turning angle position signals $P_a$ which are taken at the counter circuit 13*e* at Step S10. The data of cylinder I obtained by the cylinder discriminating operations are stored in the RAM 13*c*.

At Step S11, information of the revolution of the engine indicative of the revolution number N of the engine 1 is taken from the counter circuit 13*e*. Then, at Step S12, information of the intake-air quantity which represents the quantity of intake-air A to the engine is read. At Step S13, operations for the fundamental injection quantity are carried out on the basis of the two kinds of information. At Step S14, the correction coefficient K stored in the RAM 13*c* at the previous Step S3 is read to correct the fundamental injection quantity W. At Step S15, determination is made as to whether or not a cylinder failure flag is newly set at Step S10 in the cylinder discriminating process. When YES, an instruction to set the fuel-injection to all fuel-injection counters in the output circuit 13*f* is given to perform simultaneous injection of fuel from the first through the sixth electromagnetic type fuel-injection valves 91–96, after that the interruption processing rutine is returned to the main rutine.

On the other hand, at Step S15, when the determination is negative, then, further determination is made as to whether or not the cylinder failure flag remains in setting condition at Step S17. When YES, the rutine is returned to the main rutine. When it is found that the cylinder failure flag is reset, an amount of fuel to be injected is set for the fuel-injection counter corresponding to the data of cylinder I in the output circuit 13*f* at Step S18, and thereafter, the rutine is returned to the main rutine.

The detail of the cylinder discriminating process to be carried out at the above-mentioned Step S10 will be described with reference to FIG. 5.

At Step S100, a value M to be compared is read from the counter circuit 13*e*. The value M obtained by counting the turning angle position signals $P_a$ (FIG. 6*a*) by the counter circuit 13*e* when the reference signal $P_b$ is in, for instance, high levels as shown in FIG. 6*b*. Generally, the value M is taken, for instance, as 50 when the width of the reference signal $P_b$ for the first cylinder is determined to be, for instance, 50° CA and the values for the other cylinders are determined to be, for instance, 42 when the width of the reference signal for any of the second through the sixth cylinders is determined to be, for instance, 42° CA.

At Step S101, determination is made as to whether or not the values M of comparison is 40 or lower. When $M \leqq 40$ there exists a noise pulse $P_{b2}$ (wherein $P_{b2}$ corresponds to $L_2$° CA and $L_2 \leqq 40$). Then, the cylinder failure flag is set in the RAM 13*c* at Step S102 to finish the cylinder discriminating rutine.

On the other hand, when $M > 40$ at Step S101, then, further determination is made as to whether or not the values M for comparison is 46 or lower at Step S103. When $M \leqq 46$, the present data of cylinder I is renewed by adding a numerical value "1" to the previous data of cylinder I at Step S104, and thereafter, the sequential step goes to Step S107.

On the other hand, when $M > 46$ at Step S103, further determination is made as to whether or not the values M for comparison is 52 or higher at Step S105. When $M \geqq 52$, there exists a noise pulse $P_{b1}$ (wherein $P_{b1}$ corresponse to $L_1$° CA and $L_1 \geqq 52$). Then, the cylinder failure flag is set in the RAM 13*c* at step S102 to thereby finish the cylinder discriminating rutine. On the other hand, when $M < 52$, a numerical value "1" is set for the data of cylinder I at Step S106; the cylinder failure flag in the RAM 13*c* is reset, and thereafter, the sequential step goes to Step S107. At Step S107, the present data of cylinder I renewed at Step S106 or S104 are stored in the RAM 13*c* and the cylinder discriminating rutine is finished.

The fuel injection may be started in synchronism with the raising time of the reference signal $P_b$, or is started when a value obtained by counting the turning angle position signals $P_a$ from a falling time of the reference signal $P_b$ becomes a predetermined value.

FIG. 6 shows that the first through the sixth electromagnetic type fuel-injection valves 91–96 are simultaneously actuated in a time period t1 in FIGS. 6*c*–6*h* when the noise pulse $P_{b1}$ is detected. After the simultaneous fuel-injection to the all cylinders, further fuel-injection is stopped until the reference signal $P_b$ for the first cylinder having the width of pulse corresponding to 50° CA is detected.

There is possibility of simultaneous fuel-injection on detection of the noise pulse $P_{b2}$. However, such fuel-injection is prohibited since the simultaneous fuel-injection has just been carried out by detectin of the noise pulse $P_{b1}$. In the normal operations of the fuel-injection to the engine, they are obtainable waveformes as indicated by solid lines in FIGS. 7*a*–7*i*.

Thus, in accordance with the above-mentioned embodiment of the present invention, simultaneous fuel-injection is performed when a value obtained by counting the turning angle position signals is out a predetermined range, and further fuel-injection is prohibited until a specified cylinder is detected. Accordingly, occurrence of unstable revolution of the engine or engine stop is avoidable.

A second embodiment of the fuel control apparatus of the present invention will be described. The general construction of the second embodiment of the present invention is the same as that of the first embodiment as shown in FIGS. 1 and 2. The main rutine and the interruption processing rutine to perform the operations of the second embodiment is also the same as those in FIGS. 3 and 4. Accordingly, the description referred to the first embodiment with reference to FIGS. 1–4 applies to the second embodiment.

Cylinder discriminating rutine as in the second embodiment will be described with reference to FIGS. 7 and 8.

Figure 7:
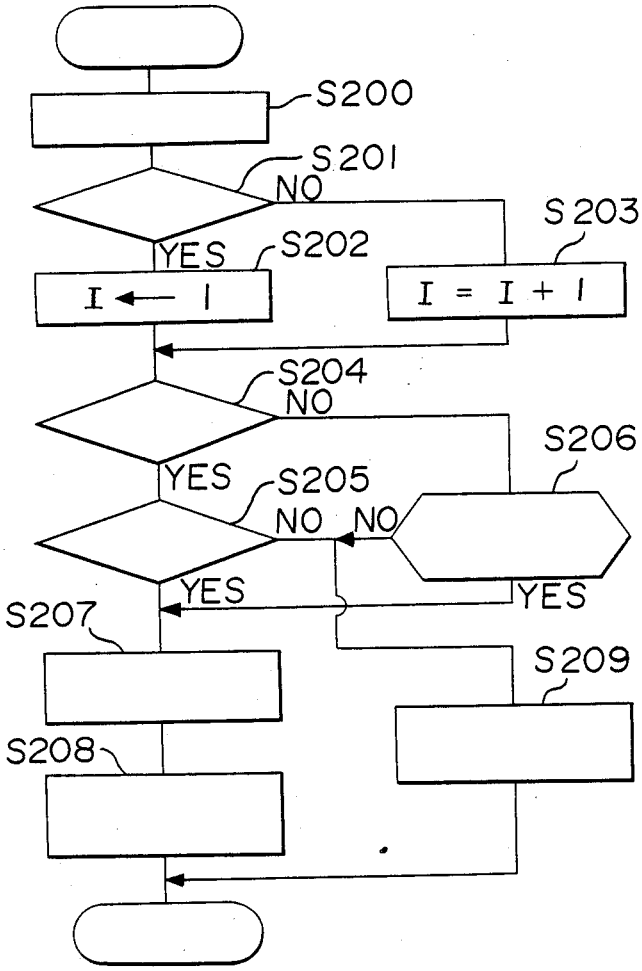
FIG. 7 is a flow chart for cylinder discriminating rutine to be inserted in an interruption rutine which is, in turn, inserted in the main rutine for a second embodiment of the fuel control apparatus according the present invention.
Figure 8:
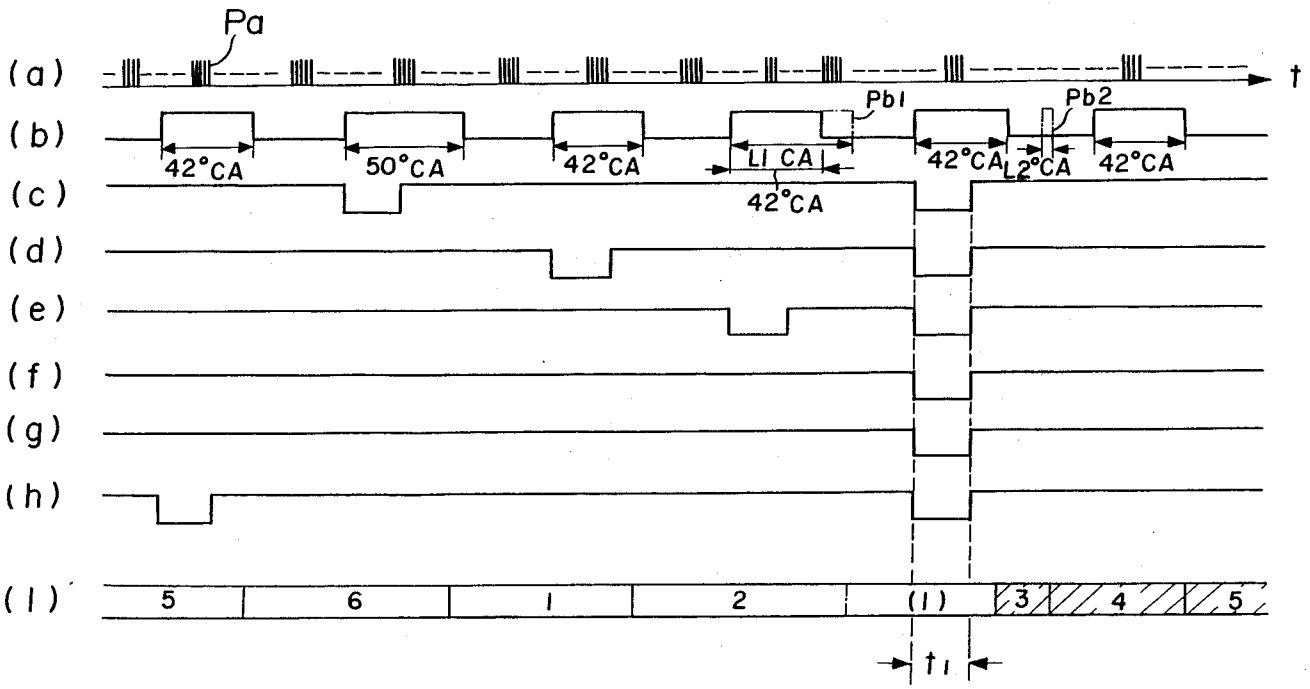
FIGS. 8*a–i* are a timing chart showing the operations of the second embodiment of the present invention; and, FIGS. 9*a–j* are a timing chart showing the operations of the conventional fuel control apparatus.
Figure 9:
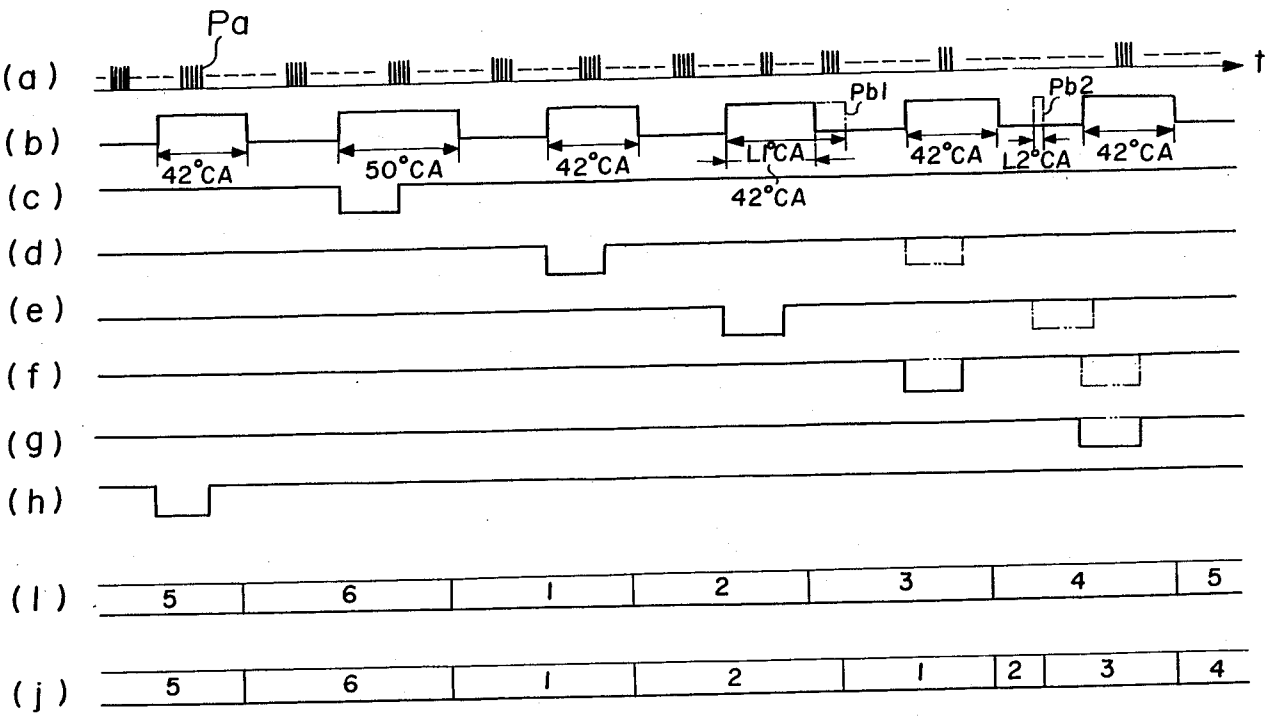
FIGURE 9 PRIOR ART

In FIG. 7, values M to be compared are read from the counter circuit 13*e* at Step S200. The values M for comparison are those obtained by counting the turning angle position signals $P_a$ (FIG. 8*a*) by the counter circuit 13*e* when the reference signal $P_b$ is in, for instance, high levels as shown in FIG. 8*b*. Generally, the values M for comparison are determined to be, for instance, 50 when the reference signal $P_b$ for the first cylinder is determined to have the width of pulse corresponding to, for instance, 50° CA, and the values M for comparison are determined to be, for instance, 42 when the reference signal $P_b$ for any of the second through the sixth cylinders is determined to have a width of pulse corresponding to, for instance, 42° CA.

At Step S201, determination is made as to whether or not the values M for comparison is 46 or higher. When $M \geqq 46$, judgement is made for the first cylinder. Then, the data of cylinder I are set to be 1 at Step S202. On the other hand, when $M < 46$, the present data of cylinder I are renewed by adding a numerical value "1" to the previous data of cylinder I at Step S203. At Step S204, determination is made as to whether or not the previous data of cylinder is "6". When the previous data of cylinder indicate "6", then, further determination is made as to whether or not the previous data of cylinder indicate "1" at Step S205. When YES, the represent data of cylinder are stored in the RAM 13*c* at Step S207, and thereafter, the cylinder failure flag is reset at Step S208. On the other hand, when the present data of cylinder $\neq 1$ at Step S205, the cylinder failure flag is set in the RAM 13*c* at Step S209.

On the other hand, when the previous data of cylinder $\neq 6$ at Step S204, then, the sequential step goes to Step S206 at which determination is made as to whether or not the difference between the present data of cylinder and the previous data of cylinder is "1". When YES, Step S207 and Step S208 are sequentially taken to reset the cylinder failure flag. If the judgement is found to be "NO" the cylinder failure flag is set at Step S209. Thus, by setting or resetting the cylinder failure flag at Step S208 or Step S209, the cylinder discriminating rutine is finished.

In the same manner as the case shown in FIG. 6*i*, when the noise pulse $P_{b1}$ having the width corresponding to $L_1$° CA, (where $L_1 \geqq 46$) is produced, the previous data of cylinder indicate "2" and the present data of cylinder indicate "1" (in this case, the numerical data are not stored in the RAM 13*c*). Accordingly, the sequential Steps S200, S201, S202, S204, S206 and S209 are taken in this order in FIG. 7. In this case, since the cylinder failure flag is newly set at Step S209, fuel-injection for all of the cylinders is set in the corresponding fuel-injection counters in the output circuit 13*f* at Step S16 in FIG. 4. By setting the fuel-injection, simultaneous fuel-injection is performed for the first through the sixth electromagnetic fuel-injection valves 91–96 in a time period t in the timing chart of FIGS. 8*c–8h*. Once the simultaneous fuel-injection takes place, further erroneous injection of fuel according to incorrect data of cylinder is prohibited unless the next reference signal $P_b$ having the width of pulse corresponding to 50° CA is detected to correctly renew the data of cylinder to be "1". There is possibility of simultaneous fuel-injection on detection of the noise pulse $P_{b2}$ (wherein the width of the pulse $P_{b2}$ corresponse to $L_2$° CA and $L_2 < 46$). However, such simultaneous fuel-injection is not induced in the case shown in FIG. 8 because the simultaneous fuel-injection has just performed by the previous noise pulse $P_{b1}$ and further fuel-injection is prohibited.

When the reference signal $P_b$ is correctly provided, the data of cylinder are renewed as indicated by the solid lines in FIGS. 9*a–9i* and the fuel-injection is performed to the cylinders in accordance with the data of cylinder.

The fuel-injection may be started in synchlonism with, for instance, the rising time of the reference signal $P_b$ or may be started when a value obtained by counting the turning angle position signals $P_a$ from a falling time in the reference signal $P_b$ becomes a predetermined value.

Thus, in accordance with the second embodiment of the present invention, the simultaneous fuel-injection is performed when the data of cylinder show the values other than those of a predetermined order, and further fuel-injection is prohibited until a specified cylinder among the first through the sixth cylinders is detected. Therefore, there is obtainable smooth operations of the engine without causing unstable revolution and the engine stop.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel control apparatus for an n-cycle engine which comprises:

a turning angle sensor which outputs a turning angle position signal each time the crank shaft of said n-cycle engine turns a predetermined angle, and outputs a reference signal of a predetermined range of the turning angle for each of the cylinders in n-cycle operations;

a cylinder discriminating means which counts the turning angle position signals in a rising time period or a falling time period in said reference signal, compares a counted value with a set value, and renews data of cylinder for the cylinders with respect to a specified cylinder said; and, a fuel-injection control means for controlling injection of fuel to the cylinders having the renewed data, wherein when said cylinder discriminating means detects that said counted value is out said predetermined range, said fuel-injection control means performs simultaneous injection of fuel to all of said cylinders, and the fuel injection is prohibited until said cylinder discriminating means detects said specified cylinder.

2. The fuel control apparatus according to claim 1, wherein when said counted value is out said predetermined range, a cylinder failure flag is set before the simultaneous injection of fuel.

3. The fuel control apparatus according to claim 1, wherein said counted value is respectively compared with first, second and third set values in which said first set value is determined to be higher than a reference value for said specified cylinder; said second set value is determined to be lower than set values for the cylinders other than said specified cylinder, and said third set value is between said first and second set values, and wherein when said counted value is greater than said first set value or smaller than said second set value, a cylinder failure flag is set; when said counted value is between said first set value and said third set value, said data of cylinder are renewed at which time said cylinder failure flag is reset, and when said counted value is between said second set value and said third set value, the numerical value of "1" is added to said data of cylinder.

4. A fuel control apparatus for an n-cycle engine which comprises:

a turning angle sensor which outputs a turning angle position signal each time the crank shaft of said n-cycle engine turns a predetermined angle, and outputs a reference signal of a predetermined range of the turning angle for each of the cylinders in n-cycle operations;

a cylinder discriminating means which counts the turning angle position signals in a rising time period or a falling time period in said reference signal, compares a counted value with a set value, and renews data of cylinder for the cylinders with respect to a specified cylinder;

a fuel-injection control means for controlling injection of fuel to the cylinders having the renewed data; and, a detection means for detecting said data of cylinder being in disorder, wherein when said detection mean detects the data being in disorder, said fuel-injection control means performs simultaneous injection of fuel to all of said cylinders, and the fuel injection is prohibited until said cylinder discriminating means detects said specified cylinder.

5. The fuel control apparatus according to claim 4, wherein when said counted value is out said predetermined range, a cylinder failure flag is set before the simultaneous injection of fuel.

6. The fuel control apparatus according to claim 4, wherein in a case where said engine has 6 cylinders, determination is made respectively as to whether or not the previous data of cylinder show the numerical value of "6" and the present data of cylinder show the numerical value of "1", and wherein when the previous data$\neq$6, determination is made as to whether or not the value of the present data minus the value of the previous data equals to "1"; when the previous data=6 is affirmative, determination is made as the value of the present data is 1, and when the value of the present data$\neq$1 or the value of the present data−the value of the previous data$\neq$1, a cylinder failure flag is set.

* * * * *